US012758015B2

(12) United States Patent
Meyer

(10) Patent No.: US 12,758,015 B2
(45) Date of Patent: Oct. 13, 2026

(54) SHELF SAFETY PIN FOR CABINET

(71) Applicant: Vertiv Corporation, Westerville, OH (US)

(72) Inventor: Adam Meyer, Columbus, OH (US)

(73) Assignee: Vertiv Corporation

( * ) Notice: Subject to any disclaimer, the term of this patent is extended or adjusted under 35 U.S.C. 154(b) by 65 days.

(21) Appl. No.: 18/893,658

(22) Filed: Sep. 23, 2024

(65) Prior Publication Data

US 2025/0127301 A1 Apr. 24, 2025

Related U.S. Application Data

(60) Provisional application No. 63/592,612, filed on Oct. 24, 2023.

(51) Int. Cl.

| | |
|---|---|
| ***A47B 96/02*** | (2006.01) |
| ***A47B 88/50*** | (2017.01) |
| ***A47B 96/06*** | (2006.01) |

(52) U.S. Cl.

CPC ..... *A47B 96/025* (2013.01); *A47B 96/06* (2013.01); *A47B 88/50* (2017.01)

(58) Field of Classification Search

CPC ..... A47B 57/408; A47B 57/485; A47B 67/04; A47B 88/00; A47B 88/407; A47B 88/427; A47B 88/43; A47B 88/477; A47B 88/50; A47B 88/57; A47B 2088/4272; A47B 2088/4274; A47B 2088/4276; A47B 2088/4278; A47B 96/025; A47B 96/06; A47B 96/066; E05B 65/0014; E05B 65/0053; E05B 65/005; E05B 65/46; H05K 5/0021; H05K 77/18; H05K 7/183; H05K 7/186; H05K 7/1488; H05K 7/1489; H05K 7/1425; E05C 1/04; E05C 1/004; E05C 1/10; E05C 1/16; E05C 1/116;

(Continued)

(56) References Cited

U.S. PATENT DOCUMENTS 3,357,762 A * 12/1967 Forsyth ..... A47B 63/00 312/289
6,299,223 B1 * 10/2001 Ji ..... E05C 5/02 292/175

(Continued)

FOREIGN PATENT DOCUMENTS

GB 2245156 A 1/1992
KR 20140041536 A 4/2014

OTHER PUBLICATIONS

EP Application No. 24208473.9 Extended European Search Report; Issued Mar. 27, 2025; 9 pages.

*Primary Examiner* — Daniel J Troy
*Assistant Examiner* — Elizabeth Irene Artalejo
(74) *Attorney, Agent, or Firm* — Dickinson Wright PLLC

(57) ABSTRACT

A shelf safety pin assembly for a cabinet comprising at least one removable shelf is disclosed. The safety pin assembly includes a bracket, a safety pin, a spring, and a safety pin release. The safety pin movably coupled to the bracket and includes an engagement end having a rear-facing stopping surface and a forward-facing camming surface. The spring is configured to bias the engagement end towards a stopping structure. A cabinet including a frame, at least one removable shelf configured to be mounted within the frame, and the shelf safety pin assembly is also disclosed.

13 Claims, 3 Drawing Sheets

(58) Field of Classification Search
CPC ..... E05C 9/025; Y10T 292/0969; Y10T 292/0974; Y10T 292/098; Y10T 292/0977; Y10T 292/0999; Y10T 403/32434; Y10T 292/097; Y10T 292/51; Y10T 292/55; Y10T 292/63; F16B 21/12; F16B 7/105; F16B 19/02
USPC ..... 312/333, 334.44, 334.7; 292/163, 164, 292/166, 179; 403/105, 109.1, 109.6, 403/109.8, 324, 328, 379.5; 108/152
See application file for complete search history.

(56) References Cited

U.S. PATENT DOCUMENTS

| | | | | |
|---|---|---|---|---|
| 6,398,445 | B1 * | 6/2002 | Matali Badia | F16B 7/105 403/379.5 |
| 9,861,196 | B2 * | 1/2018 | Chen | A47B 88/50 |
| 10,765,028 | B1 * | 9/2020 | Beall | H05K 7/1489 |
| 10,934,749 | B2 * | 3/2021 | Braz | E05C 1/04 |
| 11,284,719 | B2 * | 3/2022 | Frank | A47B 88/941 |
| 12,464,664 | B2 * | 11/2025 | Nakamura | H05K 7/183 |
| 2005/0052850 | A1 | 3/2005 | Dickey et al. | |
| 2009/0256453 | A1 * | 10/2009 | Wang | E05B 65/46 312/222 |
| 2014/0175811 | A1 * | 6/2014 | Fu | E05C 1/04 292/179 |
| 2017/0016256 | A1 * | 1/2017 | Park | H01H 9/22 |

* cited by examiner

SHELF SAFETY PIN FOR CABINET

CROSS REFERENCE TO RELATED APPLICATIONS

This U.S. Non-Provisional Patent Application claims the benefit of U.S. Provisional Patent Application Ser. No. 63/592,612 titled "Shelf Safety Pin For Cabinet" filed Oct. 24, 2023, the entire disclosure of which is hereby incorporated by reference.

FIELD

The present disclosure relates generally to safety pins and specifically to a safety pin for shelves removable from a cabinet.

BACKGROUND

Cabinets, such as equipment racks, organize equipment, such as servers, network switches, and battery modules, for example, into standardized assemblies that make efficient use of space and other resources. Cabinets can store a mix of different equipment or the same type of equipment. For example, a battery cabinet is an equipment rack having a plurality of slidable shelves, each shelf holding a battery module.

However, some equipment, especially battery modules, can be very heavy and can cause serious injury if dropped. When service is required on a battery module, a technician typically removes the shelf from the battery cabinet. If the shelf is pulled too fast, the momentum from the combined weight of the battery module and shelf can be hard to overcome. As a result, the battery module may fall from the battery cabinet, possibly injuring the technician.

SUMMARY

An aspect of the disclosed embodiments includes a shelf safety pin assembly for a cabinet comprising at least one removable shelf. The safety pin assembly comprises a bracket, a safety pin, a spring and a safety pin release. The safety pin is movably coupled to the bracket and comprises an engagement end having a rear-facing stopping surface and a forward-facing camming surface. The spring is configured to bias the engagement end towards a stopping structure. The safety pin release is configured to disengage the safety pin from the stopping structure.

Another aspect of the disclosed embodiments includes a cabinet comprising: a frame; at least one removable shelf configured to be mounted within the frame; and at least one shelf safety pin assembly. The at least one shelf safety pin assembly comprises a bracket, as safety pin, a spring and a safety pin release. The safety pin is movably coupled to the bracket and comprises an engagement end having a rear-facing stopping surface and a forward-facing camming surface. The spring is configured to bias the engagement end towards a stopping structure. The safety pin release is configured to disengage the safety pin from the stopping structure.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features may be arbitrarily expanded or reduced for clarity.

DETAILED DESCRIPTION

The following discussion is directed to various embodiments of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1A:
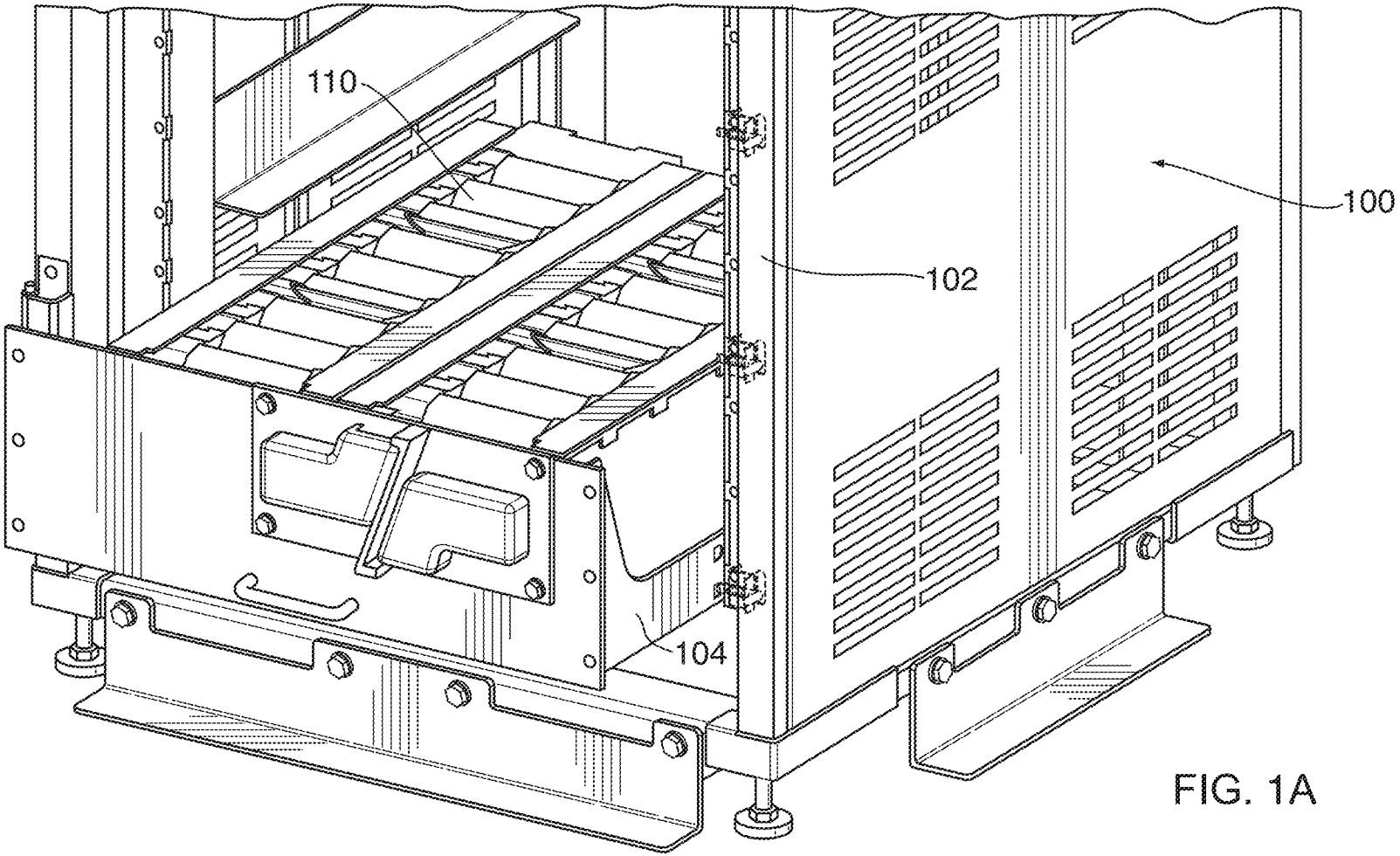
FIG. 1A generally illustrates a perspective view of a portion of a cabinet according to the principals of the present disclosure.
Figure 1B:
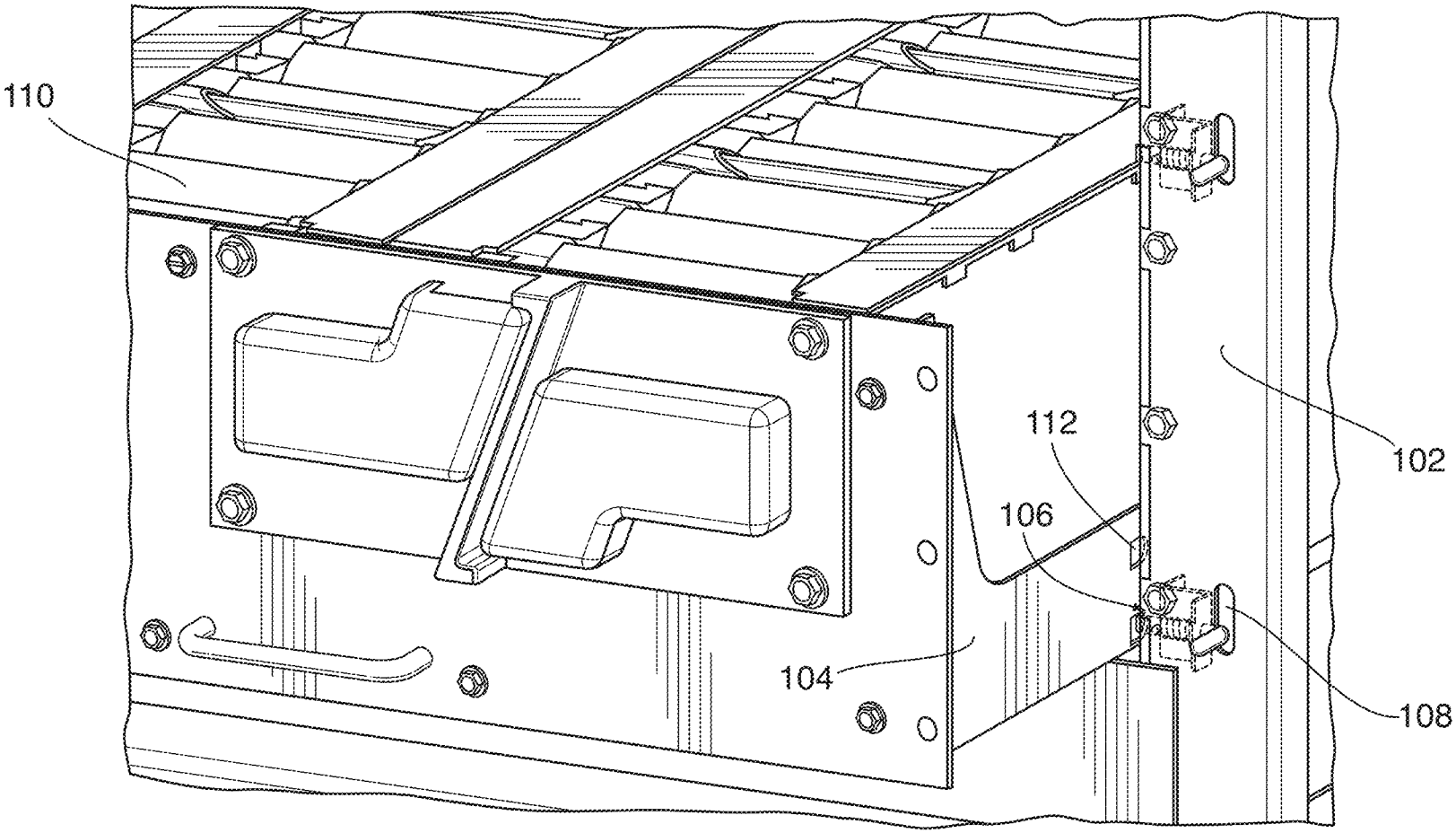
FIG. 1B is generally illustrates an enlarged view of a pin assembly, removable shelf, and frame of the cabinet illustrated in FIG. 1A.

For convenience, like numerals in the description refer to like structures in the drawings. Referring to FIGS. 1A and 1B, a cabinet in accordance with some embodiments is illustrated generally by numeral 100. The cabinet 100 may include a frame 102, at least one removable shelf 104, and a safety pin assembly 106. The frame 102 may include openings 108 proximal each removable shelf 104. In some embodiments, the openings 108 include slots in the frame 102.

The removable shelf 104 may include equipment 110 mounted thereon. In some embodiments, the equipment 110 may include at least one battery module. The removable shelf 104 may also include at least one stopping structure 112 along its length. In some embodiments, the stopping structure 112 may be a recess.

Figure 2A:
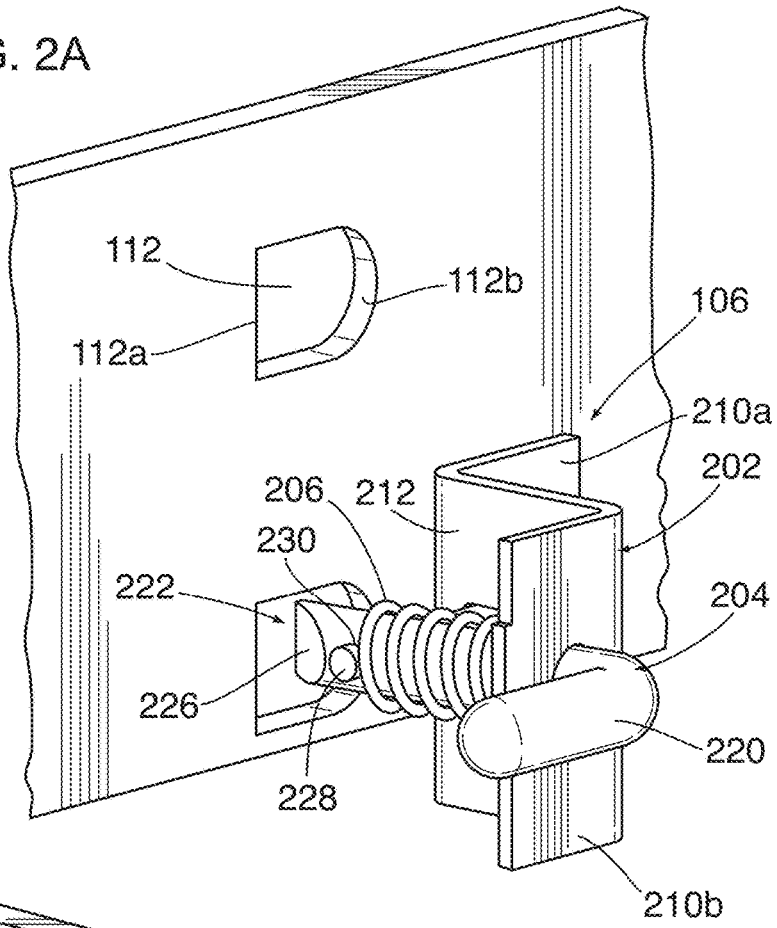
FIG. 2A generally illustrates a front perspective view of the pin assembly and the removable shelf.
Figure 2B:
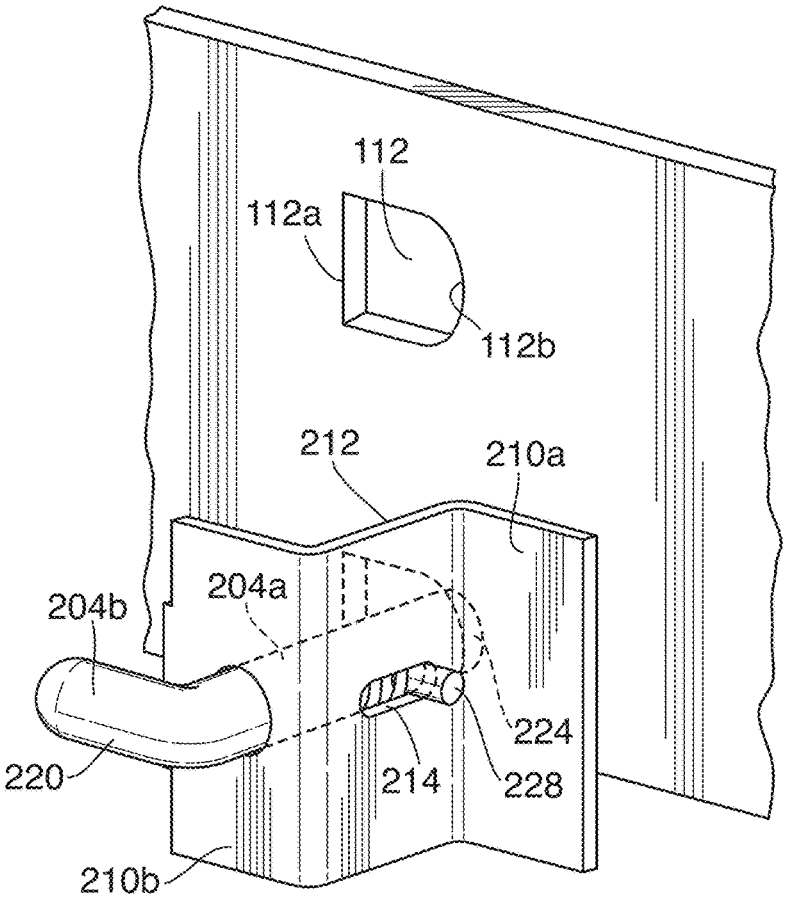
FIG. 2B generally illustrates a rear view of the pin assembly.

Referring to FIGS. 2A and 2B, the safety pin assembly 106 and the recess 112 are illustrated in greater detail. In some embodiments, the recess 112 may include a D-shaped profile. Accordingly, the recess may have a flat front edge 112*a* and a rounded rear edge 112*b*. In some embodiments, the recess 112 may be positioned at a tipping point of the removable shelf 104. As will be appreciated, the tipping point refers to a position at which the weight of a portion of the removable shelf 104, including the battery module 110 stored thereon, that is positioned outside of the cabinet 100 may be sufficiently heavy to cause the removable shelf 104 to tip and fall out of the cabinet 100.

The safety pin assembly 106 may include a bracket 202, a safety pin 204, and a biasing member 206. The bracket 202 may be configured to be mounted to the cabinet 100. In some embodiments, the bracket 202 may be z-shaped. Accordingly, the bracket 202 may include a first arm 210*a* and a second arm 210*b* offset from one another. The first arm 210*a* and the second arm 210*b* may be connected by a connecting arm 212. The bracket 202 may be configured to be mounted to the frame 102 so that the first offset arm 210*a* is proximal the removable shelf 104 and the second offset arm 210*b* is distal from the removable shelf 104. The connecting arm 212 may include a guide slot 214. The second offset arm 210*b* may include an opening.

The safety pin 204 may be movably coupled to the bracket 202. The safety pin 204 may include a handle 220 and an engagement end 222. The handle 220 and the engagement end 222 may be at opposite ends of the safety pin 204. The handle 220 may be configured to protrude through the opening in the bracket 202 and through the slot 214 in the frame 102 so that it accessible by a user. The safety pin may include a first portion 204*a* and a second portion 204*b* extending from the first portion 204*a* at an angle relative to the first portion 204*a*. In some embodiments, the first portion 204*a* may be longer than the second portion 204*b*. In some embodiments, the angle may be between 1 degree relative to the first portion 204*a* and 179 degrees relative to the first portion 204*a*. In some embodiments, the angle may be 90 degrees relative to the first portion 204*a*. In some embodiments, the angle may be approximately orthogonal (e.g., 80-100 degrees; or 85-95 degrees). In some embodiments, the safety pin 204 may be L-shaped. In some embodiments, second portion 204*b* may be configured to serve as the handle the handle 220 of the safety pin 204.

The engagement end 222 may include a rear-facing stopping surface 224 and a forward facing camming surface 226. The safety pin 204 may include an edge that is beveled. The non-beveled edge of the engagement end 222 forms the stopping surface 224 and the beveled edge of the engagement end 222 defines the camming surface 226.

The safety pin 204 may further include a guide pin 228. In some embodiments, the guide pin 228 may extend through a bore 230 in the safety pin 204 and may be configured to slidably engage the guide slot 214 of the bracket 202. The guide pin 228 may be positioned proximal the engagement end 222 of the safety pin 204.

The biasing member 206 may be configured to bias the engagement end 222 of the safety pin 204 towards the removable shelf 104. In some embodiments, the biasing member 206 may be a spring (e.g., a coil spring, a leaf spring, etc.). The spring 206 may be coupled between the guide pin 228 and the second arm 210*b* of the bracket 202.

Operation of the safety pin assembly 106 is described as follows. Without the shelf 104 in the cabinet 100, the safety pin 204 encounters no resistance. As a result, the spring 206 biases the safety pin 204 so that the engagement end 222 is positioned in the path of the shelf 104. When the shelf 104 is slid into the cabinet 100, the rear end of the side of the shelf 104 contacts the camming surface 226 of the safety pin 204. The force of the shelf 104 against the camming surface 226 causes the safety pin 204 to move away from the shelf 104 and compress the spring 206.

As the shelf 104 continues to slide toward the rear of the cabinet 100, the engagement end 222 of the safety pin 204 slides along the side of the shelf 104 until it reaches the recess 112. At the recess 112, the shelf 104 no longer applies any force to the safety pin 204, so the spring 206 causes the engagement end 222 to move into a gap created by the recess 112. The engagement end 222 of the safety pin 204 traverses the recess 112 until the front edge 112*a* of the recess 112 contacts the camming surface 226 of the safety pin 204.

The slope of the camming surface 226 is configured so that the force of the front edge 112*a* of the recess 112 on the camming surface 226 causes the safety pin 204 to move away from the shelf 104 and compress the spring 206. The engagement end 222 of the safety pin 204 continues to slide along the side of the shelf 104 until the shelf 104 is completely inserted into the cabinet 100.

As the safety pin 204 moves into and out of the recess 112, the guide pin 228 slides along the guide slot 214 of the bracket 202. Thus, the guide pin 228 restricts the safety pin 204 to substantially lateral translation and inhibits rotation of the safety pin 204 about its axis.

When removing the shelf 104 from the cabinet 100, the shelf 104 is pulled forward out of the cabinet 100. The engagement end 222 of the safety pin 204 slides along the side of the shelf 104 until it reaches the recess 112. At the recess 112, the shelf 104 no longer applies any force to the safety pin 204, the spring 206 causes the engagement end 222 to move into a gap created by the recess 112. The engagement end 222 of the safety pin 204 traverses the recess 112 until the rear edge 112*b* of the recess 112 contacts the stopping surface 224 of the safety pin 204.

The shape the stopping surface 224 may be configured so that the force from the rear edge 112*b* of the recess 112 does not cause the safety pin 204 to move away from the shelf 104. For example, in some embodiments, the shape of the stopping surface 224 and the shape of the rear edge 112*b* of the recess 112 are complementary. Thus, the interaction between the stopping surface 224 and the rear edge 112*b* of the recess may inhibit further motion of the shelf 104 in the forward direction. In some embodiments, to overcome the obstruction caused by the safety pin 204, the user pulls the handle 220 to manually move the safety pin 204 away from the shelf 104, compressing the spring 206. Once the safety pin 204 has been moved out of the recess 112, the shelf 104 can continue to be pulled forward. Accordingly, the handle 220 may serve as a safety pin release. The safety pin 204 continues to slide along the side of the shelf 104 until the shelf 104 is completely removed from the cabinet 100.

Accordingly, it will be appreciated that the shelf 104 can be inserted into the cabinet 100 without requiring the user to manually manipulate the safety pin assembly 106. In contrast, when removing the shelf 104 from the cabinet 100, the safety pin assembly 106 inhibits the shelf 104 from being removed past the tipping point. In order to completely remove the shelf 104 from the cabinet 100, the user must manually manipulate the safety pin assembly 106 to release the shelf 104.

In the embodiments described above, the shelf 104 may be configured to slide into and out of the cabinet 100. In other embodiments, the shelf 104 may be configured to roll into and out of the cabinet using a roller system.

Further, the recess 112 may include a profile shape other than a D-shape. For example, the recess 112 may include a rectangular or square-shaped profile. Further, the shape of the recess 112 may not complement the shape of the safety pin 204. Rather, any shape may be used as long as the recess 112 and the safety pin 204 interact with each other to cam the safety pin 204 away from the shelf 104 when the shelf 104 is being inserted into the cabinet 100 and to inhibit motion of the shelf 104 when the shelf 104 is being removed from the cabinet 100. Further, the edge of the safety pin 204 may be tapered, chamfered, or the like.

When the safety pin 204 extends into the recess 112, it may engage a bottom surface thereof. Alternatively, the safety pin 204 may float within the recess 112 so that it does not engage the bottom surface thereof. This feature may be controlled by adjusting the depth of the recess and/or the distance that the safety pin 204 can protrude from the frame 102. The latter may be adjusted, for example, by altering the length of the safety pin 204, the position of the guide pin 228 on the safety pin 204, the length or position of the guide slot 214, or any combination thereof.

In some embodiments, multiple recesses 112 may be provided in the side of the shelf 104. For example, two or more recesses 112 may be aligned vertically, as illustrated in FIG. 2*a*. Such a configuration allows the safety pin assembly 106 to be mounted to the frame 102 at different positions. This provides flexibility with regard to the size of the shelves 104, different equipment 110, or structural features/limitations of the frame 102. As another example, two or more recesses 112 may be aligned horizontally along the length of the shelf 104. Such a configuration may stop the shelf 104 multiple times when it is being removed from the cabinet 100.

In some embodiments, the shelves 104 may include equipment 110 other than the at least one battery module.

In some embodiments, the recess 112 may be implemented in a guide that is attached to the shelf 104. Such embodiments may allow the user to adapt older or third-party shelves to be used in combination with the safety pin assembly 106.

In some embodiments, the safety pin assembly 106 may be mounted to the shelf 104. A guide may be mounted to the frame 102. The guide may include the recess 112 at the tipping point for the shelf 104. In some embodiments, the safety pin 204 functions similar to that described above with the necessary changes to account for the fact that it is mounted on the shelf 104 and not the frame 102. For example, the spring 206 may bias the safety pin 204 towards the guide. As another example, the camming surface 226 may be shaped to cam the safety pin 204 away from the guide when the shelf 104 is being inserted into the cabinet 100.

Because the safety pin assembly 106 is positioned on the shelf 104, it may be difficult to access the handle 220 to release the safety pin 204 from the recess 112. Accordingly, a different safety pin release may be provided. For example, the bottom surface of the recess 112 may be moveable in response to a push button or other user input. Accordingly, in response to the user input, the bottom surface of the recess 112 may be moved so that it is at least flush with the guide. This can facilitate the release of the safety pin 204 and allow the shelf 104 to be withdrawn from the cabinet 100.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

The word "example" is used herein to mean serving as an example, instance, or illustration. Any aspect or design described herein as "example" is not necessarily to be construed as preferred or advantageous over other aspects or designs. Rather, use of the word "example" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment or implementation unless described as such.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

Also, the use of "a" or "an" is employed to describe elements and components described herein. This is done merely for convenience and to give a general sense of the scope of the invention. This description should be read to include one or at least one and the singular also includes the plural unless it states otherwise.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

What is claimed is:

1. A shelf safety pin assembly for a cabinet comprising at least one removable shelf, the shelf safety pin assembly comprising:

a bracket having a longitudinal bore formed therein, the bore extending in a longitudinal direction;

a safety pin extending in the longitudinal direction from a handle end to an engagement end having a rear-facing stopping surface and a forward-facing camming surface, wherein the safety pin is coupled to the bracket and is moveable in the longitudinal direction with respect to the bracket, and wherein a guide pin is fixed to the safety pin and extends radially outward from the safety pin through the longitudinal bore in the bracket, thereby preventing rotation of the safety pin, including the rear-facing stopping surface and the forward-facing camming surface; and a spring configured to bias the safety pin in the longitudinal direction.

2. The shelf safety pin assembly of claim 1, wherein the bracket is configured to be mounted to the cabinet, and the at least one removable shelf comprises a stopping structure toward which the spring is configured to bias the safety pin.

3. The shelf safety pin assembly of claim 2, wherein the stopping structure comprises at least a recess in the at least one removable shelf.

4. The shelf safety pin assembly of claim 3, wherein the recess is shaped to complement a shape of the safety pin.

5. The shelf safety pin assembly of claim 4, wherein the recess includes a D-shaped profile.

6. The shelf safety pin assembly of claim 1, wherein the handle end of the safety pin comprises a handle extension extending an angle relative to the longitudinal direction.

7. The shelf safety pin assembly of claim 1, wherein the safety pin includes an edge that is at least one of beveled, tapered, or chamfered, and wherein the edge defines the camming surface.

8. A cabinet comprising:

a frame;

at least one removable shelf configured to be mounted within the frame; and at least one shelf safety pin assembly comprising:

a bracket having a longitudinal bore formed therein, the bore extending in a longitudinal direction;

a safety pin extending in the longitudinal direction from a handle end to an engagement end having a rear-facing stopping surface and a forward-facing camming surface, wherein the safety pin is coupled to the bracket and is moveable in the longitudinal direction with respect to the bracket, and wherein a guide pin is fixed to the safety pin and extends radially outward from the safety pin through the longitudinal bore in the bracket, thereby preventing rotation of the safety pin, including the rear-facing stopping surface and the forward-facing camming surface; and a spring configured to bias the safety pin in the longitudinal direction.

9. The cabinet of claim 8, wherein the bracket is configured to be mounted to the cabinet, and the at least one removable shelf comprises a stopping structure toward which the spring is configured to bias the safety pin.

10. The cabinet of claim 9, wherein the stopping structure comprises at least a recess in the at least one removable shelf.

11. The cabinet of claim 10, wherein the recess is shaped to complement a shape of the safety pin.

12. The cabinet of claim 11, wherein the recess includes a D-shaped profile.

13. The cabinet of claim 8, wherein the handle end of the safety pin comprises a handle extension extending at an angle relative to the longitudinal direction.

* * * * *